US007059486B2

(12) United States Patent
Van Der Heijden et al.

(10) Patent No.: US 7,059,486 B2
(45) Date of Patent: Jun. 13, 2006

(54) PLASTIC CONTAINER WITH ROUNDED SHOULDERS

(75) Inventors: Johannes Arnoldus Petrus Van Der Heijden, Oosterhout (NL); Alian Yves Maria Dirven, Oosterhout (NL); Dolf Franz De Jong, Amersfoort (NL)

(73) Assignees: Akzo Nobel N.V., Arnhen (NL); Wiva Verpakkingen B.V., Oosterhout (NL)

( * ) Notice: Subject to any disclaimer, the term of this patent is extended or adjusted under 35 U.S.C. 154(b) by 388 days.

(21) Appl. No.: 10/332,600

(22) PCT Filed: Jul. 6, 2001

(86) PCT No.: PCT/EP01/07831

§ 371 (c)(1),
(2), (4) Date: May 5, 2003

(87) PCT Pub. No.: WO02/04299

PCT Pub. Date: Jan. 17, 2002

(65) Prior Publication Data

US 2004/0011785 A1 Jan. 22, 2004

(30) Foreign Application Priority Data

Jul. 11, 2000 (EP) ..... 00202462

(51) Int. Cl.
*B65D 1/02* (2006.01)
*B65D 1/18* (2006.01)

(52) U.S. Cl. ..... 215/379; 315/10; 315/382; 220/4.13; 220/675

(58) Field of Classification Search ..... 215/379, 215/381, 382, 10; 220/4.13, 675
See application file for complete search history.

(56) References Cited

U.S. PATENT DOCUMENTS

| | | | | |
|---|---|---|---|---|
| 3,708,082 | A | 1/1973 | Platte | 215/1 C |
| 4,372,455 | A * | 2/1983 | Cochran | 215/385 |
| 4,733,804 | A * | 3/1988 | Slat et al. | 222/465.1 |
| 4,969,922 | A * | 11/1990 | Platte, Sr. | 215/383 |
| 5,255,889 | A * | 10/1993 | Collette et al. | 249/102 |
| D391,854 | S * | 3/1998 | Ankney et al. | D9/520 |
| D392,188 | S * | 3/1998 | Darr et al. | D9/520 |

FOREIGN PATENT DOCUMENTS

| | | | |
|---|---|---|---|
| FR | 2617804 | | 1/1989 |
| JP | 6397607 | * | 6/1988 |

(Continued)

OTHER PUBLICATIONS

Patent Abstract of JP 11236022 (Aug. 1999).

(Continued)

*Primary Examiner*—Sue A. Weaver
(74) *Attorney, Agent, or Firm*—Richard P. Fennelly; Louis A. Morris

(57) ABSTRACT

A plastic container for the storage and transport of liquids, particularly aggressive liquids, comprising a practically rectangular bottom, a top wall with a filling or pouring hole, and standing walls which each connect to the circumferential seam of both the bottom and the top, and four standing edge strips each connecting two walls, which container is manufactured by the blow-molding process, wherein the standing wall portions have a convex form, wherein either the standing edge strips widen at the top and the bottom and, as seen in a cross-section running parallel to the bottom, the standing edge strips have a radius of curvature equal to or greater than that of the standing wall portions to which they are connected.

8 Claims, 4 Drawing Sheets

FOREIGN PATENT DOCUMENTS

| | | | |
|---|---|---|---|
| JP | 7205258 | * | 8/1995 |
| JP | 8301253 A | * | 11/1996 |
| JP | 3050587 | * | 5/1998 |
| WO | 99/22994 | | 5/1999 |

OTHER PUBLICATIONS

International Search Report for: PCT/EP01/07831; dated Oct. 1, 2001.

* cited by examiner

FIG. 5
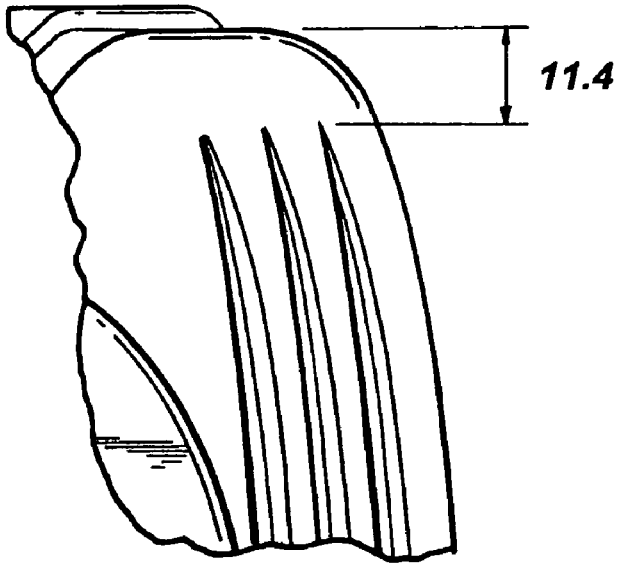
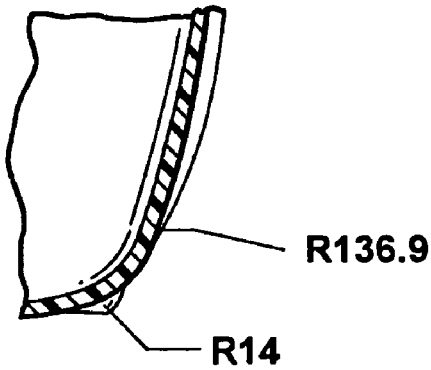
FIG. 6a
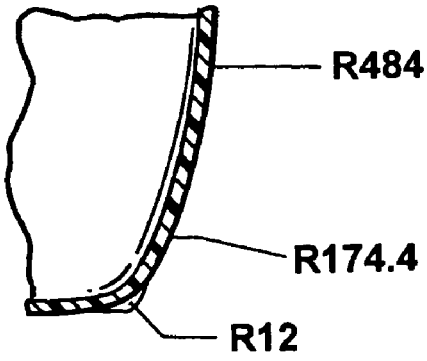
FIG. 6b

PLASTIC CONTAINER WITH ROUNDED SHOULDERS

CROSS REFERENCE TO RELATED APPLICATIONS

This application was filed pursuant to 35 U.S.C. 371, based on International application No. PCT/EP01/07831, filed Jul. 6, 2001, and claims priority from EPO application No. 00202462.8, filed Jul. 11, 2000.

BACKGROUND OF THE INVENTION

1. Field of the Invention

The invention relates to plastic containers for the storage and transport of liquids, particularly aggressive liquids.

2. Prior Art

The above type containers comprise a practically rectangular bottom with rounded corners, a top with a filling or pouring hole, four standing walls which each connect to the circumferential seam of both the top and the bottom, and four standing edge strips each connecting two walls, a rounded corner of the bottom and a corner of the top, which container is manufactured by the blow molding process.

Such containers are widely used and frequently stacked with other containers on a pallet and transported. Consequently, such containers must be self-bearing, meaning that they should have sufficient strength to withstand the weight of other containers and their contents stacked on top of them during storage and transport. FR-A-26178, for instance, describes such containers.

However, the strength of such containers, particularly of containers holding 15 kg of liquid or more, is limited. Furthermore, it was observed that the strength of containers holding aggressive liquids, especially liquids that (partially) migrate into the wall material, is adversely affected, often to such an extent that they cannot withstand the usual load. The option of thicker walls, by using more material in the blow molding process, is uneconomic. Furthermore, if the containers are to hold thermally liable liquids that show self-accelerating decomposition, such as organic peroxides, they cannot be made too sturdy, since such containers have to rupture at fairly low pressures to prevent hazardous situations (such as explosions) as per the recommendations of the United Nations Committee of Experts on the Transport of Dangerous Goods.

The object of the invention is to present a new type of blow-molded container with increased compression strength at equal weight that is suitable for holding said aggressive fluids. This is achieved by means of a special container design. Of course, this design will also allow the production of lighter containers with the same strength as conventional containers, thereby reducing the amount of plastic material required.

SUMMARY OF THE INVENTION

In one embodiment the invention comprises a plastic container for the storage and transport of liquids comprising a substantially rectangular bottom, a top with at least a filling or pouring hole, four standing wall portions which each connect to the circumferential seam of both the bottom and the top, and four standing edge strips each connecting two wall portions. The standing wall portions are convex and the standing edge strips widen at the top and the bottom and, as seen in a cross-section running parallel to the bottom, the standing edge strips have a radius of curvature equal to or greater than that of the standing wall portions to which they are connected.

BRIEF DESCRIPTION OF THE DRAWINGS

FIG. 5 is a detail of the top right-hand part of the container of FIG. 2, FIG. 6*a* shows cross-section C–C' of FIG. 1, FIG. 6*b* shows cross-section D–D' of FIG. 1.

The same reference numerals are used in the figures for the same components.

DETAILED DESCRIPTION OF THE INVENTION

Figure 1:
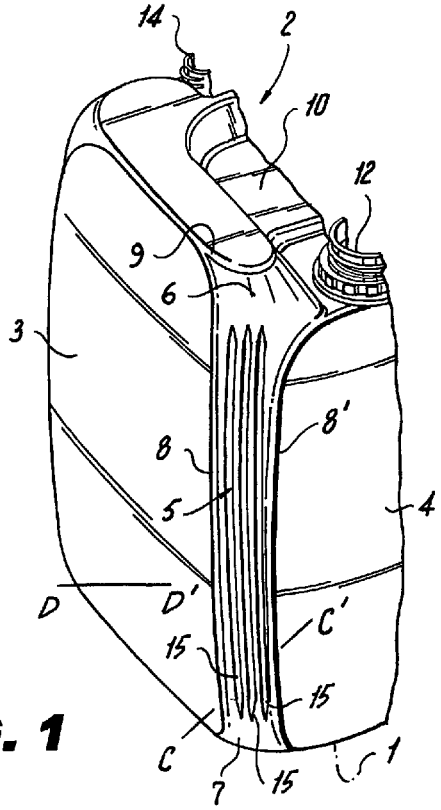
FIG. 1 shows a perspective side view of half a container according to the invention.

The plastic container according to the invention stands out because the standing edge strips widen at the top and the bottom, such that the average length of the bounding line between the top and bottom surfaces and the wall portion is 0.15 to 3 times the length of the bounding line between the edge strip and the top and bottom surfaces. Because the edge strips widen toward the top and also toward the bottom, the delicate transition in the corners of the container is made smoother, resulting in improved transfer of the vertical forces.

In a container according to another embodiment of the invention, the edge strips take on a flatter form, i.e. as seen in a cross-section running parallel to the bottom, the standing strip has a radius of curvature equal to or greater than that of the connecting wall portion, in which process the above-stated force transfer is improved. A sharp edge between standing strip and wall element is undesired because it reduces the ability to pass a drop test of a filled container. Therefore it is preferred that the transition from the standing strip into the wall element is a smooth one.

In preferred containers the standing strips are stiffened in the longitudinal direction, perpendicular to the plane of the bottom and top walls, for instance by means of a conventional ridged, or otherwise ribbed, structure. In this way the force transfer is improved even further and containers can be stacked with a reduced risk of collapse.

According to a feature of the invention, the width of the end portion of the edge strip in one embodiment is about ⅓or more of half the height of said edge strip. In a vertical section, perpendicular to the plane of the bottom and top walls, this end portion moreover preferably has a radius of curvature which becomes increasingly smaller, so that the end portion transposes smoothly, or substantially smoothly, into the top and bottom surfaces. This means that the radius of curvature, starting from the bounding line of the edge strip and the top or bottom, in either direction increases continuously until it matches the radius of curvature of edge strip and top or bottom, respectively.

In another preferred embodiment, the wall elements are at least convex in the vertical plane, meaning that none of the side walls have flat surfaces. When stacked, the side walls of adjacent containers will typically touch at midlength. This may be less desirable because the labels of the adjacent containers will then rub against each other and because locking elements as disclosed in FR-A-26178 cannot be located near the top and bottom walls.

However, the strength of containers with such convex walls was found to be unsurpassed. Especially stacked containers that are stored in the usual way, meaning that the temperature is not perfectly constant, were found to have improved stack stability. Although there is no wish to be limited to such a theory, it is expected that such preferred containers will be better at resisting deformation, e.g. due to a vacuum created in the container when the temperature decreases.

In a further preferred embodiment, the top wall of the container is equipped with one or more vertical elements that have, in total, two or more slots or other connective means, which are located in a recessed area of the top wall. The slots are not in the horizontal plane. A handle can be attached to the container using these slots and fastening means in a conventional way. Preferably, the recessed area of the top wall, the handle, fastening means, slots, and vertical elements are designed such that the top of the handle, when in its lowest position, will not interact with the bottom of another container stacked on top of it, while a gloved hand is able to slide between said handle and the top wall when the top of the handle is in its highest position. Such a design increases the load bearing capacity of a container with handle, because most of the forces are carried through the sides of top and bottom elements and easily transferred to the wall and the standing edge strip elements, while maximizing the volume of the container and allowing easy handling, such as emptying, of said container.

Preferably, the handle is not a (hollow) integral part of the top portion of the container, such as is typically seen in conventional (smaller) containers such as milk jugs. Such (hollow) handles make the blow molding operation according to which the present containers are made much more cumbersome and typically result in a less than optimal use of the plastic material employed. More specifically, in order to prevent weak spots around the handle area, a thicker wall is typically needed in comparison to containers with the same strength but without said (hollow) handles. It is furthermore noted that integral handles are often designed such that they protrude from the top wall. In that case the chances of passing the drop test of a filled container is reduced while also stacking is less efficient.

A container according to the present invention is pre-eminently suited to being made in a mold, which as is usual consists of two half-molds in mirror image relationship to the plane of symmetry of an upright central plane of the container. These half-molds can be opened up and closed together again, enabling a process in which a premold is laid up against the inner wall of the mold by means of blow molding, where the container can be released after curing. Such a mold is normally limited to a specified volume, for instance 15 liters. There are conventional molds wherein one or more extra segments are introduced such that the wall section of the containers is extended and, accordingly, the volume of the final containers is increased, for instance to 30 or 60 liters. The introduction of such additional segments causes a disruption in the wall elements of the container, unless the sides of the containers are flat. For convex wall elements according to the invention, however, the disruption in the walls (meaning that the radius of the wall, when viewed in the plane perpendicular to the wall and perpendicular to the bottom, does not change continuously over the full height of the container but shows distinct transitions between parts with a different radius) causes the containers to be less strong.

The invention therefore has for its object to provide the half-mold with an interchangeable middle portion which serves to restrict the size of the convex middle section of the wall and the part of the edge strip located between its end portions, which interchangeable middle portions differ in height and have distinctive radii of curvature so as to give a smooth curve of the middle sections and the end portions of the total side wall.

The container according to the present invention consists of a substantially rectangular bottom part 1 with rounded corners, a top wall 2, and standing wall portions 3, 4 that connect the top and bottom walls.

Figure 2:
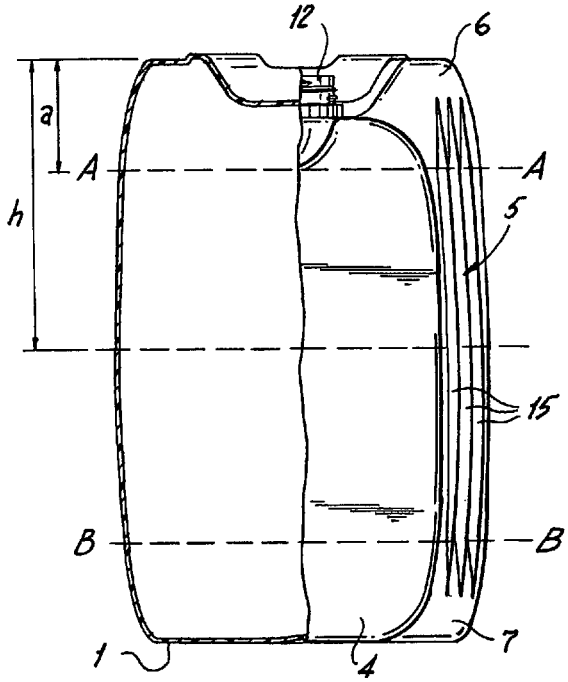
FIG. 2 shows a front view, partly in standing section, of the container of FIG. 1.

The wall portions consist of side faces 3, 4, with sandwiched between them an edge strip 5 which connects these faces. Preferably, the side walls are convex in the vertical plane, as shown in FIG. 2. More preferably, the bulging of the container is such that the circumference at half height of the container is at least 5%, preferably at least 10% more than the circumference of the side walls at a distance of 1 cm from the top and/or bottom. Preferably, the circumference at half height of the container is not more than 50%, preferably not more than 30% more than the circumference at the top and/or bottom of the container.

According to the main feature of the invention, the edge strip 5 widens toward the top into part 6 and toward the bottom into part 7.

Figure 7:
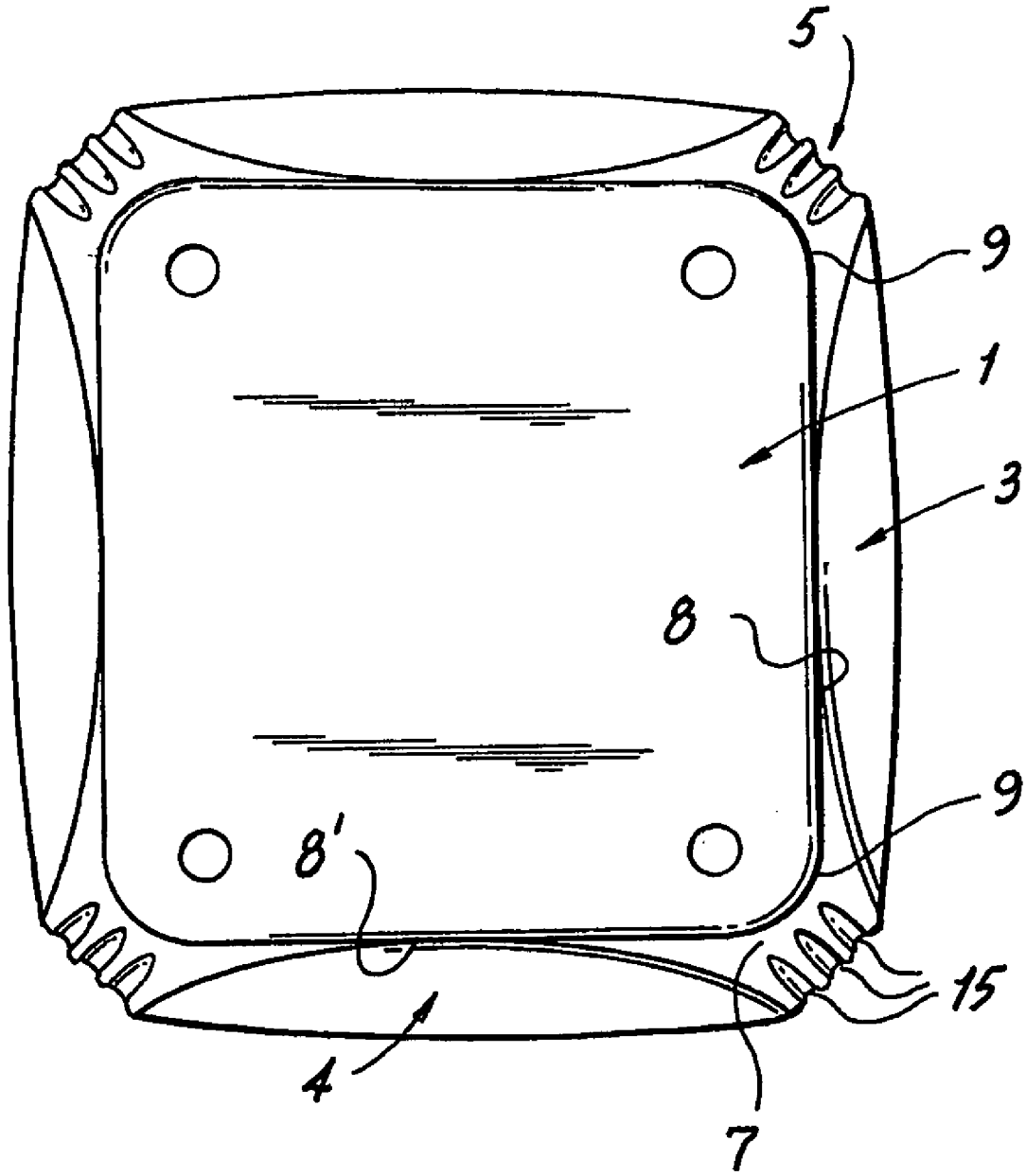
FIG. 7 is a bottom view of the container of FIG. 1.

This widening into 7 is likewise such that the length of the average bounding lines 8 and 8' between the side faces 3, 4 and the bottom is more than 0.15, preferably more than 0.3, most preferably more than 0.6 the length of the average bounding line 9 between the widened edge strips and the bottom. At the same time, the length of the average bounding lines 8 between the side face 3 and the bottom is less than 2, preferably less than 1, more preferably less than 0.8, and most preferably less than 0.75 the length of the average bounding line 9 between the widened edge strips 5 and the bottom (see FIG. 7). The same holds, mutatis mutandis, for the widening of the edge strips 5 into 6 and the bounding line of edge strips 5 and walls 3 with the top surface, such that the rounding at the top is similar to the rounding as described for the bottom. This means that the edge strip 5 runs smoothly in the shape of a shoulder into the bottom and top. The rounding is described for the connection with the bottom since there the bounding lines are not complicated by the opening(s) as present in the top.

The top surface 2 preferably is sectioned and may comprise a U-shaped higher portion 11 sandwiching a lower portion 10 which has the filling or pouring hole 12. The U-shaped portion preferably is capable of interacting with a recession in the bottom wall of another container in order to increase the stability of containers stacked on top of one another. The lower portion 10 can also have fixing elements 13, preferably slotted, for mounting a handle. Further, a vent 14 can be fitted in the top surface, which members, however, fall outside the scope of the invention. The bearing area of the top wall is formed by the U-shaped portion 11, optionally together with the handle, which therefore takes up the forces of the containers stacked thereon. These forces can be transferred via the shoulder part 6 to the standing wall strip 5 and via the shoulder part 7 to the bottom.

It was observed that in a preferred embodiment, the ribbed structure of the edge strips is such that essentially the whole of the edge strip 5, including the shoulder parts 6 and 7, is ribbed. More preferably, at least one rib ends less than 40 mm, preferably less than 20 mm, more preferably less than 15 mm, and most preferably less than 12.5 mm away from the plane of the top wall 2. In FIG. 5, a container is shown where three recessed ribs end at a distance of 11.4 mm from the plane of the top wall.

FIGS. 6*a* and 6*b* show cross-sections of the connection between the bottom wall and the edge strip 5 and the side wall 3, respectively. They present an example of how the edge strips and the side walls are smoothly connected to the bottom wall. For a container with a size of 15–60 liters, a suitable radius for the transition of side walls and/or edge strips into top wall and/or bottom wall was found to be greater than 5 mm, preferably greater than 8 mm, and less than 100 mm, preferably less than 50 mm, more preferably less than 30, and most preferably less than 20 mm, such that a smooth rounding is obtained.

If so desired, all walls may be equipped with (further) conventional elements that interlock with elements of adjacent containers to further increase the stability of stacked containers, i.e. elements that prevent the shifting of containers so that the stability of the stacked containers is increased. Also, the containers may optionally contain conventional elements on the side walls and/or edge strips to fix a (sleeve) label.

The material used in the blow molding process to form the containers according to the invention can be any suitable conventional material. Typically, use is made of a polyolefin resin. Optionally, use is made of a polyolefin copolymer or modified polyolefin, such as grafted and/or branched polyolefin (co)polymers.

Figure 3:
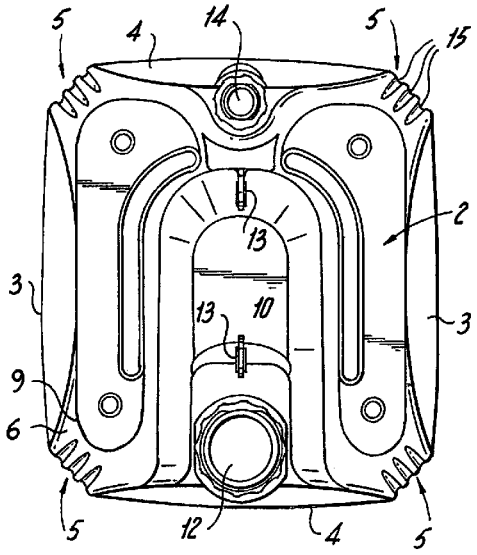
FIG. 3 is a top view of the container of FIG. 1.

It is noted that the edge strips 5 in the top view of FIG. 3 preferably are visibly flatter than the side walls, i.e. they have a larger radius of curvature. This increases the strength of the container.

It is noted that the length a of the upper and lower end portions 6, 7 of the standing wall strips 5 preferably is about ⅓ the half-height h of the edge strip 5, see FIG. 2. The dividing line A—A and the dividing line B—B located underneath it can also indicate the jointing face of interchangeable half-molds in the blow-molding process.

It has been established by computer calculations that an average transfer force of 4,800 N can be achieved with blow-molded conventional containers of 25 liters, with a weight of 1600 g., made from high-density polyethylene. With the smooth shoulders 6, 7 as proposed by the invention, a force of 7,000 N can be achieved while retaining the same wall thickness, i.e. while using the same quantity of material necessary for the manufacture of the container.

Figure 4:
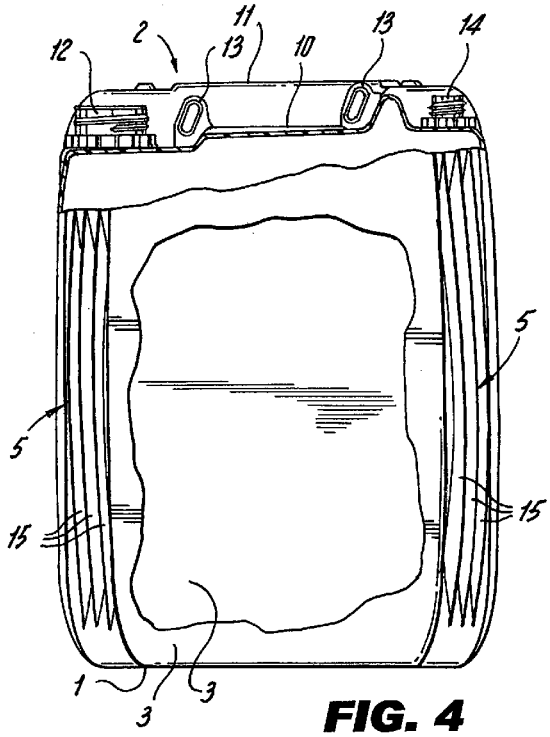
FIG. 4 is a side view, partly in cross-section, of the container of FIG. 1.

Preferably, the edge strips 5 are strengthened even further by means of longitudinal stiffening parts 15, as shown in FIGS. 2–4, which can be achieved by a ridged cross-section. In such a case the transfer forces can even reach 8,300 N. In a production run containers were produced in accordance with this most preferred embodiment. The containers had an average weight of 1450 g. The average strength was not 8,300 N but 7,000 N. Clearly, the present invention allows stronger container to be produced using conventional techniques that have a higher strength at lower weight.

The blow-moulding process is deemed to be known to the skilled person and requires no further elucidation. The molds are assembled from components known per se, although according to the invention, the special feature of the proposed mold is that the intermediate portion forming the boundary for the middle section between the separating lines A—A and B—B is interchangeable. Owing to this exchangeability option, the mold can easily be increased or decreased in size depending on the desired volume of the container. The interchangeable middle part of the molds take a form such that the curve of the radius of curvature of the end portions toward the middle section is smooth and continuous in all situations.

The invention is not limited to the above-described embodiment.

The invention claimed is:

1. A plastic container for the storage and transport of liquids comprising a substantially rectangular bottom, a top with at least a filling or pouring hole, four standing wall portions which each connect to the circumferential seam of both the bottom and the top, and four standing edge strips each connecting two wall portions, wherein the standing wall portions are convex and wherein the standing edge strips widen at the top and the bottom and, as seen in a cross-section running parallel to the bottom, the standing edge strips have a radius of curvature equal to or greater than that of the standing wall portions to which they are connected.

2. A container as claimed in claim 1 wherein, as seen in vertical cross-section, the radius of curvature of the widening end portion of the edge strip at the top and the bottom becomes increasingly smaller, so that this end portion transposes substantially smoothly into the top and bottom surfaces.

3. A container as claimed in claim 1 wherein one or more of the standing strips are stiffened in the longitudinal direction.

4. A container as claimed in claim 3 wherein the stiffening is attained by means of a ribbed structure giving a ridged cross-section to the strip.

5. A container as claimed in claim 1 wherein the end portion of the edge strip is about ⅓ of half its height.

6. A container for storage and transport of liquids comprising a substantially rectangular bottom, a top with a filling or pouring hole, four standing wall portions each connecting to the circumferential seam of both the bottom and the top, and four standing edge strips each connecting two standing wall portions, which container is manufactured by a blow-molding process, wherein the standing wall portions are convex and wherein, as seen in a cross-section running parallel to the bottom, the standing edge strips have a radius of curvature equal to or greater than that of the standing wall portions to which they are connected.

7. A container as claimed in claim 6 wherein one or more of the standing strips are stiffened in the longitudinal direction.

8. A container as claimed in claim 6 wherein the end portion of the edge strip is about ⅓ of half its height.

* * * * *